United States Patent [19]

Powers

[11] Patent Number: 4,915,088

[45] Date of Patent: Apr. 10, 1990

[54] BOW SIGHT AND METHOD OF USE

[76] Inventor: Reginald G. Powers, 5838 Bowers Rd., Imlay City, Mich. 48444

[21] Appl. No.: 336,092

[22] Filed: Apr. 11, 1989

Related U.S. Application Data

[63] Continuation-in-part of Ser. No. 153,926, Feb. 9, 1988, abandoned.

[51] Int. Cl.[4] ..... F41B 5/00

[52] U.S. Cl. ..... 124/87; 124/88; 33/265

[58] Field of Search ..... 124/86, 87, 88, 124 R; 33/265

[56] References Cited

U.S. PATENT DOCUMENTS

| | | | |
|---|---|---|---|
| 1,605,300 | 11/1926 | Thompson | 124/88 X |
| 2,642,661 | 6/1953 | Fredrickson | 124/24 R |
| 3,058,221 | 10/1962 | McNeel | 33/265 |
| 3,410,644 | 11/1968 | McLendon | 124/87 X |
| 4,542,591 | 9/1985 | Montgomery | 124/87 X |
| 4,662,347 | 5/1987 | Carlton | 124/87 |

*Primary Examiner*—Dave W. Arola
*Assistant Examiner*—Anthony Knight
*Attorney, Agent, or Firm*—Krass & Young

[57] ABSTRACT

A bow sight for compensating for the range from a bow to a target includes a frame having a rear end and a front end, with the front end position closer to the target than the rear end. A single rear V-notch sight is connected to the frame adjacent the rear end for sighting the target. A plurality of vertically arrayed front sight pins are connected to the frame adjacent the front end at locations thereon such that aligning the uppermost signal pin with the V-notch sight establishes the correct attitude for sighting the bow at any range, and aligning a lower sight pin appropriate for a particular distance with a target at that distance establishes the correct amount to hold the bow over the target for that distance. A method of use is disclosed.

7 Claims, 2 Drawing Sheets

BOW SIGHT AND METHOD OF USE

CROSS REFERENCE TO RELATED APPLICATIONS

This application is a continuation-in-part of U.S. patent application Ser. No. 153,926, now abandoned.

FIELD OF THE INVENTION

The invention relates to the field of archery, and more particularly to a bow sight and method of use to improve the accuracy of an arrow shot.

DESCRIPTION OF THE PRIOR ART

The problem of accurately sighting a bow to compensate for the affects of gravitational pull as the arrow is shot over varying distances is an old one. Prior to the invention of the compound bow, the velocity and momentum achieved by the shot arrow was relatively limited and, hence, relatively large adjustments had to be made in the attitude at which the arrows were shot to compensate for gravitational effects over varying distances. Hence, the archer would elevate the bow when sighting it, the degree of elevation being proportional to the distance between the archer and the intended target.

Since the advent of the modern compound bow, this problem has become somewhat minimized. Due to the greater velocity and resulting increased momentum of an arrow shot from a compound bow, the gravitational affects become somewhat minimized. However, even with the use of the compound bow, an arrow shot at a relatively long distance may still experience a significant drop due to the pull of gravity. This gravitational drop has been measured at as much as six inches at 20 yards.

Clearly the drops experienced by arrows shot from compound bows, and particularly from conventional bows, result in difficult aiming problems for the archer. The archer must adjust the attitude at which the arrow is shot. This attitude must be adjusted to compensate for varying distances. While such adjustment becomes easier with greater experience, still, each individual arrow shot must be individually adjusted. It is difficult for the archer to exactly duplicate the adjustment and attitude required for shooting an arrow a particular distance each time an arrow is shot.

As a partial solution to this problem, it has been common to employ a multiple bow sight which is mountable on the bow. Such sights typically employ a standard slotted rack in which multiple pins may be adjustably mounted. See, for example U.S. Pat. Nos. 4,662,347 and 4,542,591 where such prior art multiple sights are described. However, use of the multiple sights described in these two patents requires the archer to rotate the bow, thus changing its attitude, when sighting farther range targets. Elevating the front of the bow to sight these farther range targets may cause the bow to be shot out of square. In other words, when the archer attempts to line up the far range target with a lower bow sight, he may inadvertently rotate the bow about its longitudinal axis, as is described in U.S. Pat. No. 4,542,59I cited above. Obviously, such out of square sighting results in poor accuracy and frequent missed shots. U.S. Pat. No. 4,662,347 addresses itself to some extent to the solution of this problem by employing a dual sighting system wherein a rear group of sighting pins are lined up with an on bow target at the same time one of the front sighting pins is lined up with the archery target.

Applicant is also aware of a prior art "banjo bow sight" which employs multiple front and multiple rear targets. Applicant will provide copy of this reference as part of a disclosure statement.

It would be desirable to provide a bow sight for a compound or conventional bow and method of use which permits the archer to easily adjust his aim to compensate for shots of varying distances.

It would also be desirable to provide such a bow sight and method which permits the archer easily to square up the bow when it is being sighted and prevent out of square shots.

SUMMARY OF THE INVENTION

The present invention is a sight for use with a bow, such as a compound bow, to permit the archer to compensate for the gravitational pull on an arrow. The sight also permits the bow to be squared up properly relative to the target. The bow sight includes a frame having a rear end and a front end. The frame extends sufficiently far such that the rear end is disposed medial of the frame of the bow and the bowstring when the device is mounted on, for example, a conventional quiver mount of the bow. Means for mounting the frame on the bow are provided, such that the front end of the frame is positioned closer to the target than the rear end of the frame. A single vertically adjustable rear V-notch sight is connected to the frame adjacent to the rear end for sighting the target. A conventional adjustable front sight comprised of a plurality of vertically arrayed, vertically adjustable front pin means are provided which is connected to the frame adjacent the front end. The uppermost of the front pin means is used to "sight in" a close range target by aligning the target, V-notch and top sight pin. For aiming at a farther target, the bow is "held over" the target while maintaining the same attitude by keeping the V-notch aligned with the top sight pin. A lower sight pin appropriate for the longer distance is aligned with the target. Alternatively, the bow sight may be used with an existing front sight already mounted on the bow. Since a constant attitude is maintained no matter the target distance, the problem of angular deviation between the front and rear of the bow occurring when the bow is sighted for far range targets is alleviated. Longitudinal alignment is also improved because the bottom of the V-notch serves as a "pointer" to point to the aligned target and lower sight pin. The bow sight of the instant invention is light, simple and may be easily mounted on the bow, preferably at the quiver mount. It does not unduly restrict the archer's vision or render the bow cumbersome to carry.

BRIEF DESCRIPTION OF THE DRAWINGS

The various features, advantages and other uses of the present invention described and claimed will become more apparent by referring to the following detailed description and drawings in which;

DESCRIPTION OF THE PREFERRED EMBODIMENT

Figure 1:
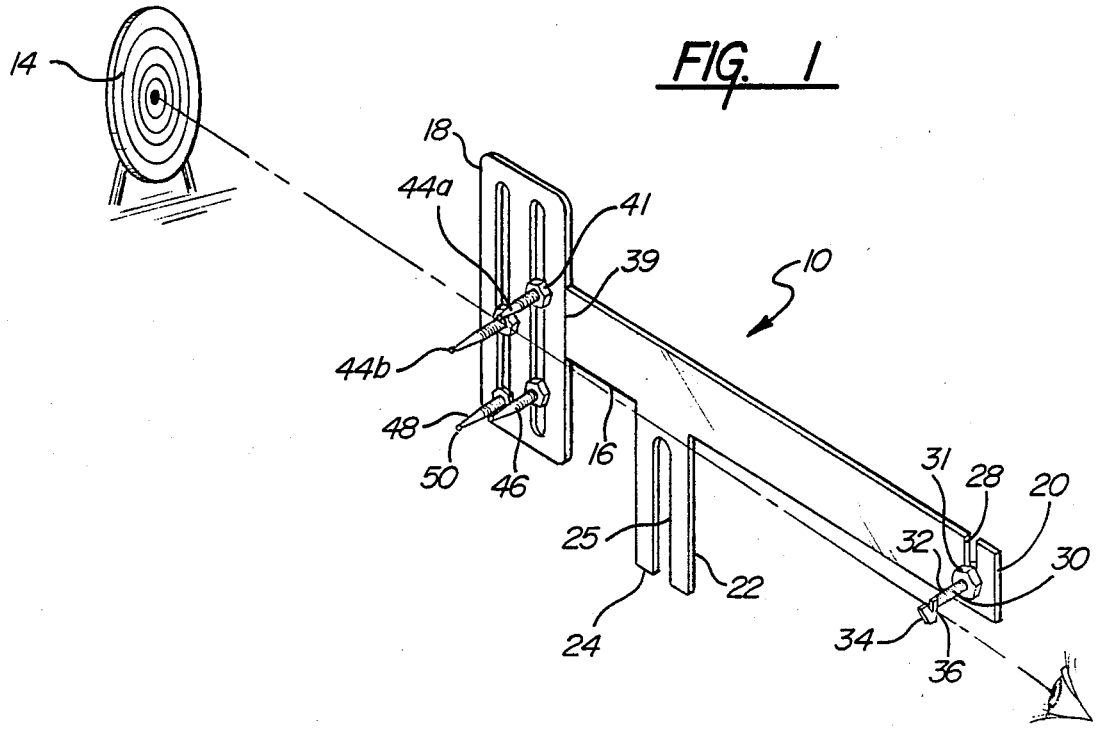
FIG. 1 is a perspective view of a bow sight constructed in accordance with the principles of the present invention sighted in at a close-range target.
Figure 2:
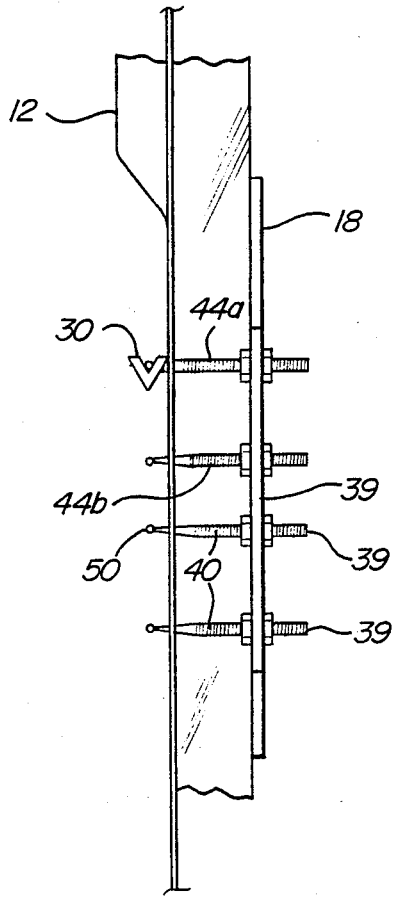
FIG. 2 is a partial rear view of the bow sight showing a rear sight aligned with the top sight pin of a multiple front bow sight for sighting in at a close-range target.

A bow sight, designated generally as 10, is shown in FIG. 1. As is shown in FIG. 2, the bow sight 10 is securable to a bow 12 for sighting a close range (20 yards, for example) target 14 and compensating for the distance or range from the bow 12 to the target 14. The bow sight 10 includes a frame 16 having a rear end 18 and a front end 20. Means 22 for mounting the frame 16 to the bow 12 are provided. The mounting means 22 can include a mounting bracket 24 which depends downwardly from the frame 16 between the rear end 18 and the front end 20. The mounting bracket 24 can include an upwardly extending slot 25 allowing passage of a fastener (not shown) for attachment of the frame 16 to the bow 12. The mounting means 22 shown in FIG. 1 is particularly adapted to mount the bow sight 10 on the bow 12 at a conventional quiver mount (not shown). It should be apparent to those skilled in the art of mounting bow sights to bows that various configurations of the mounting bracket 24 may be employed departing from the spirit and scope of the invention disclosed herein. In particular, it is recognized that various modifications to the mounting bracket 24 may be employed to adapt the bow sight 10 to a particular manufacturer's bow.

The bow sight 10 according to the present invention includes a single rear V-notch sight means, generally designated 26, connected to the frame 16 adjacent the rear end 18 for sighting the target 14. The rear sight means 26 includes a vertical rear slot 28 formed in a frame 16 adjacent the rear end 18 and a rear sight pin 30 engagable through the rear slot 28. The rear sight pin 30 has an elongated threaded shaft portion 32 and is secured to the frame, preferably allowing vertical and horizontal adjustment of the rear sight pin 30 with respect to the frame 16. The vertical adjustment of the rear sight pin 30 can be accomplished by loosening a nut 31 to allow vertical movement of the rear sight 30 pin in the vertical rear slot 28. Horizontal adjustment of the rear sight pin 30 can be accomplished by rotating the elongated threaded shaft portion to move the rear sight pin 30 inwardly or outwardly with respect to the frame 16. Tightening of the nut 31 securely mounts the rear sight pin 30 on the frame 16. The rear sight pin 30 includes two downwardly and inwardly sloping surfaces, 34 and 36 forming a V-notch sight.

Referring now to FIGS. 1 and 2, the bow sight 10 also includes a front sight means, generally designated as 39, connected to the frame 16 adjacent the front end 20. The front sight means 39 comprises a plurality of vertically arrayed front sights 40.

The close range target 14 is aligned with the rear sight pin 30 and the uppermost of the front sights 40. The front sight means 39 includes a plurality of parallel, vertical front slots 42 formed in the frame 16 adjacent the front end 20 and a plurality of front sight pins 44. Each front sight pin 44 includes an elongated threaded shaft portion 46 connected to a tapered shaft portion 48 and a small sighting ball 50 connected at the end of the tapered shaft portion 48. As can be seen in FIG. 2, the sighting balls 50 project laterally of the bow for sighting thereof. Preferably, the front sight means 30 allows for vertical and horizontal adjustment. Vertical adjustments can be accomplished in the configuration disclosed in the drawing by loosening one of the nuts 41 to permit the front sight pin 44 to be moved vertically along the front slot 42. Horizontal adjustment of the front pin 44 can be accomplished by turning the threaded shaft portion 46 of the front sight pin 44 to move the small sighting ball 50 inwardly or outwardly with respect to the frame 16.

Although not depicted, the front sight means 39 may comprise an existing conventional bow sight known in the prior art and already mounted to the bow. A rear bow sight means 26 as described above may then be separately provided. In this manner, the bowsight at the present invention may be adapted for use with a bow already equipped with a conventional multiple pin, front bow sight.

Through experimentation and experience, the archer adjusts the relative positions of the rear sight pin 30 and the uppermost of the front sight pins **44*a* to "sight in" the close range target 14. When sighted correctly at 20 yards, the top sight pin 44*a*, the target 14 and the V-notch sight pin 30 are all in alignment, as is shown in FIGS. 1 and 2**. When the pins are adjusted correctly, the bow will be accurate at this range of 20 yards. The bow will remain at this attitude when farther targets are sighted.

Figure 3:
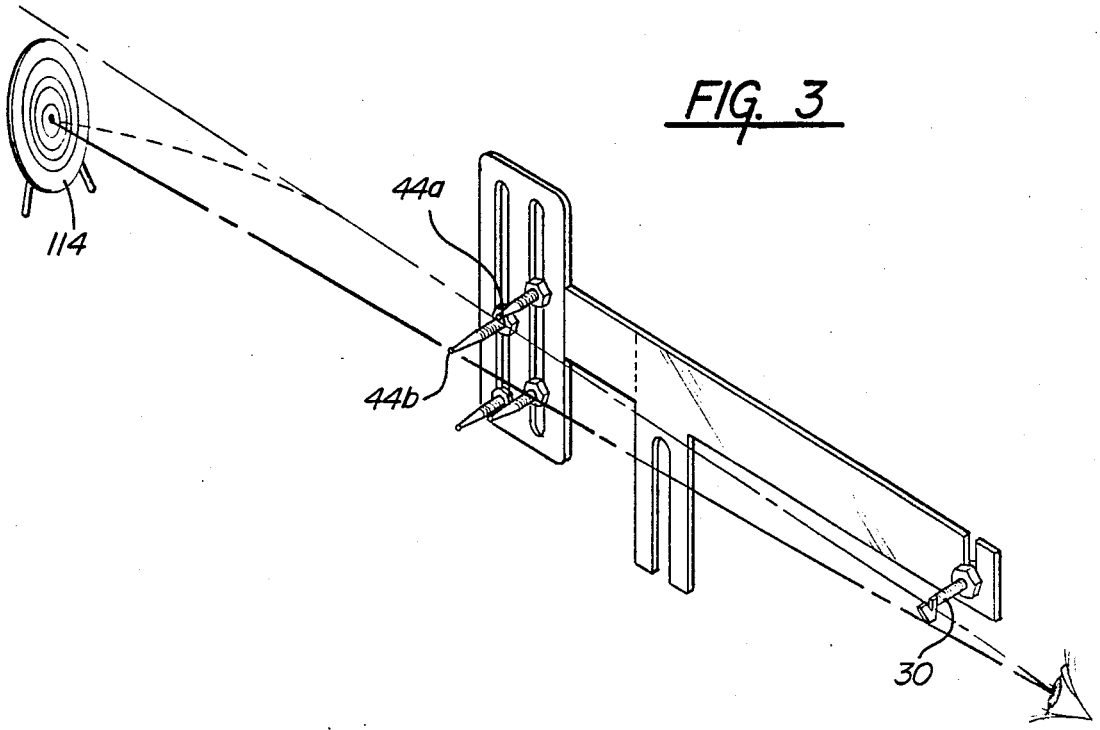
FIG. 3 is a perspective view of the bow sight of FIG. 1 sighted for shooting at a farther range target.
Figure 4:
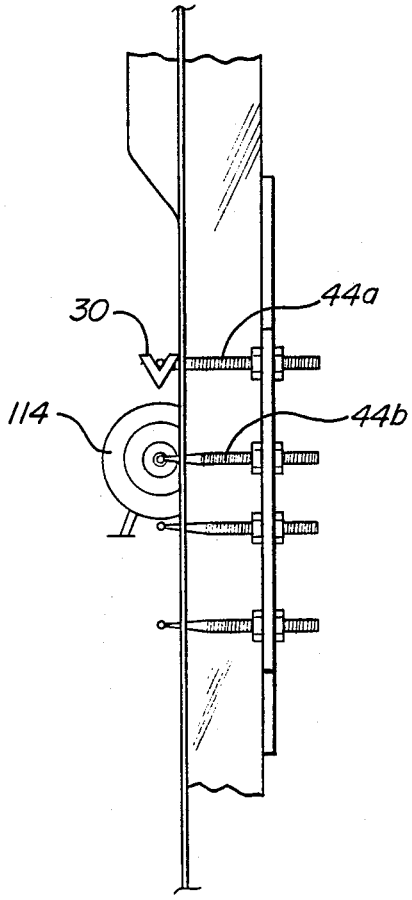
FIG. 4 is a partial rear view showing the alignment of sight pins, V-notch and target when sighting in a farther range target.

FIGS. 3 and 4 illustrate how a farther range target 114 (30 yards, for example) is sighted with the device 10. The alignment of the V-notch 30 and the uppermost sight pin **44*a* is maintained to keep the same attitude of the bow. To compensate for the drop caused by gravity encountered by an arrow while traveling a farther distance, the archer must "hold over" the target 114 by raising the bow. This is accomplished by raising the bow (while maintaining the correct attitude by keeping the V-notch in line with the top sight) until the target 114 is aligned with the next highest front sight pin, 44*b*, as shown in FIGS. 3 and 4. Again, experimentation will reveal the correct spacing of the pins 44** for an accurate shot.

In similar manner, the remaining lower pins can be used to sight in even farther range targets, such as 35 or 40 yards (not depicted). Obviously, it will be necessary for the archer to determine pin placement by directing shots at known target distances, such as at an archery range. In target shooting tournaments, minor adjustments may be required to account for windage at the particular tournament location. This can be accomplished by use of the horizontal adjustment of front sight pins 44.

Longitudinal alignment is further enhanced by using the V-notch sight 30 as a pointer when shooting at farther ranges. In FIG. 4, the bottom of the V-notch points directly at the aligned target 114 and sight pin **44*b***. Hence, the bow is much more likely to remain "in square" when shot at various distances.

While an exemplary embodiment of the invention has been described above, the foregoing description is to be considered exemplary rather than limiting, and the true scope of the invention is that defined in the following claims.

The invention that is claimed is:

1. A bow sight for use with a bow comprising:

a frame having a rear end and a front end;

means for mounting the frame on the bow with the front end positioned closer to a target than the rear end;

a single rear V-notch sight means mounted on the frame adjacent the rear end; and a front sight means mounted on the frame adjacent the front end including a plurality of vertically arrayed sight pins, the sight pins being disposed at locations on the front sight means such that, when sighting the bow at a target at a particular range, an uppermost of the sight pins is aligned with the V-notch rear sight, and one of the plurality of front sight pins being selectively aligned with various preselected farther ranges for shooting at the farther ranges while maintaining the alignment of the uppermost sight pin with the V-notch for all ranges.

2. The bow sight of claim 1, wherein the mounting means comprises a downwardly depending mounting bracket connected to the frame between the rear end and the front end and securable to the bow.

3. The bow sight of claim 1, wherein the rear sight means comprises:

a vertical rear slot formed in said frame adjacent the rear end thereof;

a rear sight having an elongated threaded portion engagable through the rear slot and securable to the frame to allow vertical and horizontal adjustment of the rear sight with respect to the frame; and two downwardly and inwardly sloping surfaces to form said V-notch sight.

4. The bow sight of claim 1, wherein the plurality of front sight pins each comprise an elongated threaded portion engagable through one of the front slots and securable to the frame to allow vertical and horizontal adjustment of each front sight pin with respect to the frame.

5. The bow sight of claim 4, wherein each front sight pin further comprises a small sighting ball connected at an end of a tapered shaft extending from the elongated threaded shaft.

6. A method of sighting a bow comprising the steps of:

providing a bow sight including:

a frame having a rear end and a front end;

means for mounting the frame on the bow with the front end positioned closer to a target than the rear end;

a single V-notch rear sight means mounted on the frame adjacent the rear end for sighting a target;

a front sight means mounted on the frame adjacent the front end including a plurality of vertically arrayed sight pins;

performing the step of setting the pins, which includes the steps of:

lining up the V-notch rear sight with a target at a preselected close range;

associating the uppermost sight pin with the close range target by disposing the uppermost sight pin at a location on the front sight means such that the uppermost sight pin aligns with the aligned close range target and V-notch rear sight; and associating each of the other of the front sight pins with a target at a preselected further range by disposing each of the other of the front sight pins at a location on the front sight such that said pin aligns with one preselected farther range target, while maintaining the alignment of the uppermost sight pin and the V-notch; and sighting the bow at a target at a particular range by aligning the V-notch with the uppermost front sight pin and the target with the front sight pin associated with the particular range.

7. The method of claim 8 comprising the further step of vertically aligning the V-notch sight with one of the other sight pins when shooting at further range targets to prevent angular deviations.

* * * * *